United States Patent [19]

Zue et al.

[11] Patent Number: 4,688,678

[45] Date of Patent: Aug. 25, 1987

[54] SORTER APPARATUS FOR TRANSPORTING ARTICLES TO RELEASING LOCATIONS

[75] Inventors: James R. Zue, Everett; Lance G. Turk, Marysville; Alfred W. Gerrans, Snohomish, all of Wash.

[73] Assignee: G B Instruments, Inc., Hollywood, Fla.

[21] Appl. No.: 596,623

[22] Filed: Apr. 4, 1984

[51] Int. Cl.[4] ..... B07C 3/02

[52] U.S. Cl. ..... 209/552; 198/365; 198/704; 209/657; 209/698; 209/900; 209/933

[58] Field of Search ..... 209/552, 584, 655, 656, 209/657, 698, 900, 908, 924, 933; 414/136; 198/477.1, 370, 365, 704, 476.1, 456, 631, 408, 803.14, 803.15

[56] References Cited

U.S. PATENT DOCUMENTS

| | | | |
|---|---|---|---|
| 1,263,485 | 4/1918 | Thornburg | 198/476.1 |
| 2,764,275 | 9/1956 | Lens | 198/704 |
| 2,964,875 | 1/1961 | McLeod et al. | 209/941 |
| 3,040,887 | 6/1962 | Cornelisor | 209/657 |
| 3,750,880 | 8/1973 | Petrovsky et al. | 209/583 |
| 3,884,370 | 5/1975 | Bradshaw et al. | 209/900 |
| 3,904,516 | 9/1975 | Chiba et al. | 209/583 |
| 4,008,813 | 2/1977 | Leersnijder | 209/900 |
| 4,310,276 | 1/1982 | Castagnoli | 209/900 |
| 4,326,636 | 4/1982 | Kawakami | 209/534 |
| 4,482,059 | 11/1984 | Horii et al. | 209/900 |
| 4,488,610 | 12/1984 | Yankloski | 209/900 |
| 4,494,655 | 1/1985 | Horii et al. | 209/900 |
| 4,509,635 | 4/1985 | Emsley et al. | 209/900 |

FOREIGN PATENT DOCUMENTS

| | | | |
|---|---|---|---|
| 7310644 | 8/1973 | Netherlands | 209/900 |

*Primary Examiner*—Robert B. Reeves
*Assistant Examiner*—Donald T. Hajec
*Attorney, Agent, or Firm*—Rey Eilers

[57] ABSTRACT

A sorting apparatus is provided for sorting articles such as film envelopes. The envelopes are loaded into carriers, on an endless conveyor, which convey them past a plurality of drop chutes. The carriers hold the envelopes so the long axes thereof, in end view, are parallel to the path of movement of the conveyor. At the proper positions, the carriers are opened to release the envelopes into selected ones of the chutes. Each envelope is directed into a preselected one of a plurality of bins, that are displaced transversely of the path of movement of the conveyor. The apparatus operates under control of a data processor which causes the conveyor and carriers to deliver the envelopes to the proper bins based on information contained in a bar code on the envelopes.

23 Claims, 13 Drawing Figures

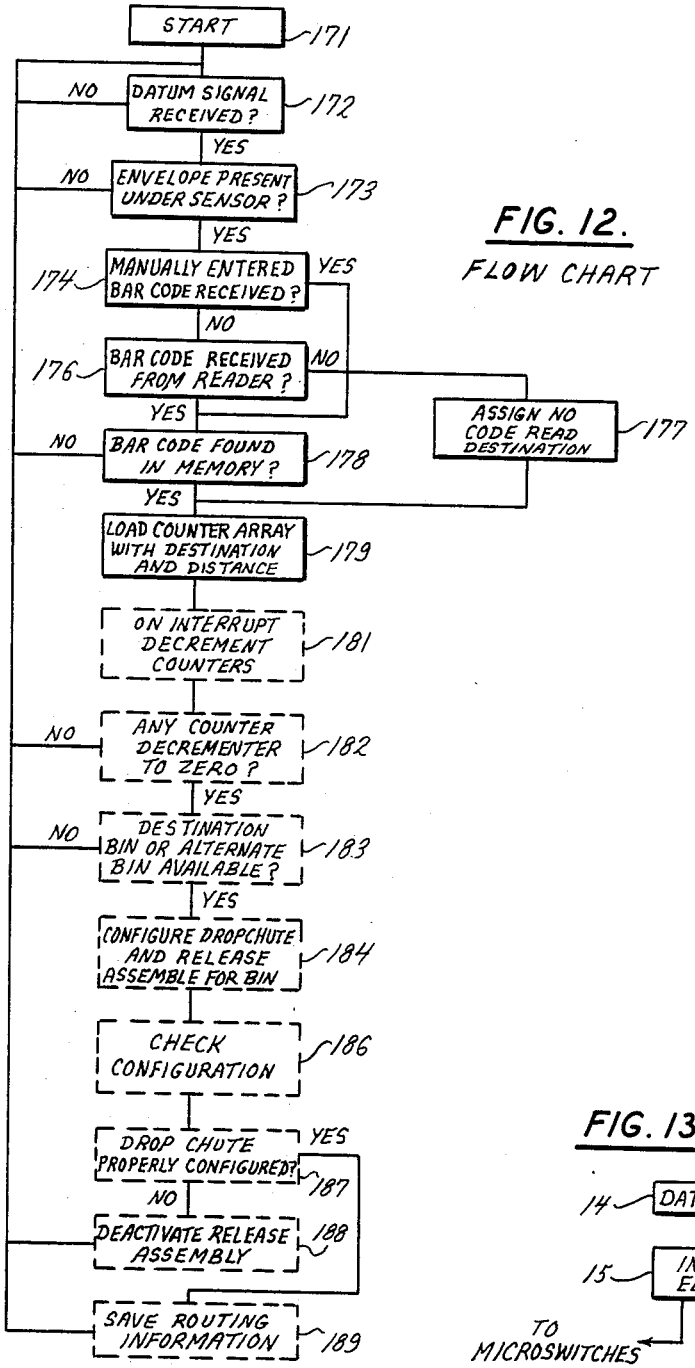
FIG. 12.
FLOW CHART
FIG. 13.
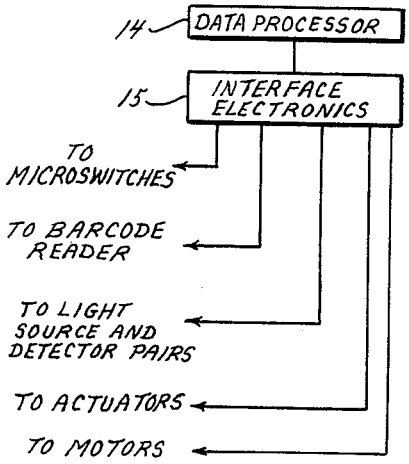

SORTER APPARATUS FOR TRANSPORTING ARTICLES TO RELEASING LOCATIONS

FIELD OF THE INVENTION

The present invention relates to apparatus for sorting articles into a plurality of bins and is particularly applicable to the art of sorting envelopes containing photographic films and prints for return to customers.

SUMMARY OF THE INVENTION

The present invention relates to apparatus for sorting articles such as envelopes or packages into a plurality of bins. Since it is particularly useful in the sorting of envelopes containing photographic film and prints, it will be described herein for illustrative purposes and without limitation with particular reference to sorting of such envelopes.

In the photofinishing industry, customers' exposed photographic film is collected from a variety of sources including drugstores, supermarkets, department stores and film processing kiosks and delivered to photofinishers for developing and printing. Increased competition among photofinishers and technological developments such as instant cameras and one-hour photofinishing systems have placed ever greater time constraints on the photofinishers to return the film and prints to collection points within a short period of time, such as 24 hours. One cumbersome step in the process of providing such 24 hours service has been the sorting of the customer envelopes, which contain the developed films and prints, with a high degree of accuracy and speed. Accordingly, the present invention provides a sorting apparatus which is well suited to the photofinishing industry but which may be used in conjunction with the sorting of mail or packages of other kinds in applications outside the photographic industries.

The present invention provides a modularized sorting apparatus which may include a plurality of carriers mounted on a continuous drive conveyor which circulates these carriers past an operator station. The conveyor moves the carriers to an upper sorting level and past the upper ends of a plurality of drop chutes. A plurality of bins are disposed vertically below each such drop chute; and those bins are spaced transversely of the path of movement of the conveyor. Each drop chute includes vertically disposed diverter gates along its length to route the envelope into the desired bin. This vertical arrangement of bins provides a highly compact sorting device capable of sorting the envelopes into a large number of discrete bins with a minimum of mechanical components.

The end of each carrier is provided with a door which is spring biased such that it will remain in either an open or closed position. When an envelope is positioned for release into the predetermined drop chute this carrier door is opened to permit the envelope to fall from the carrier into the drop chute. The spacing between adjacent drop chutes is greater than the spacing of the carriers along the conveyor such that a minimum number of carriers is in position to drop an envelope into a drop chute at any given time. The demands on the machine control system are thus spread over a greater length of time and the burden on the control system is accordingly, reduced.

In order to maximize the envelope handling capability of the system, it is essential that the carriers move as rapidly as possible. The length of time required for an envelope to fall the length of the drop tube to the point at which it is diverted into a lower bin may impose constraints on the rate at which the carriers are transported past the drop tubes. For example, at high rates of operation, a second carrier may be in position to release an envelope into a drop tube before an envelope dropped from the first carrier has reached a lower diverter gate. In order to permit more than one envelope to be falling in the drop tube at a given time, the lower diverter gates are delayed in their actuation to account for the time required for the envelope to fall to that level in the drop chute. The apparatus of the present invention can thus accommodate multiple envelopes or packages in the drop tube at a given time in order to greatly increase the capacity of the machine. In addition, the compactness and speed of the machine is improved since the rate at which carriers pass the drop tube is not governed by the length of the drop tube and the time required for the envelope to complete its transit therethrough.

Although some applications may lend themselves to the sorting of an entire batch followed by the emptying of all bins, it is frequently advantageous to permit emptying of individual bins as they become full during the sorting process. The present invention therefore includes a sensor for detecting whether a particular bin is in place and, if so, whether it is full. If either of these conditions exists, the data processing unit checks to determine if an alternate bin has been assigned to which the envelope can be delivered. If so, the apparatus is configured to deliver the envelope to such alternate bin. In the event that no available bin can be found to which the envelope can be appropriately routed, the envelope is sorted into a separate bin for undeliverable envelopes. Such envelopes may be reloaded into the sorter at a later time when the desired destination bins are in place and available to receive them. In addition, one or more of the components associated with a drop chute may malfunction during the sorting process and require maintenance. In such case, it is undesirable to shut down the entire system while the maintenance is being performed. The present invention provides for continued operation of the system during maintenance of a single drop chute by returning envelopes destined for the affected drop chute to the operator for later sorting once the drop chute has been repaired or replaced.

Although envelopes may be manually loaded into the carriers, the throughput of the machine can be increased by use of an automatic loading apparatus. At sorting speeds of 3,000 to 4,000 envelopes per hour, reliable manual insertion of the envelope into the carrier by an operator can be extremely difficult. Accordingly, the lip on the partially open front of the carrier is positioned at a sufficient height above the drive chain so that it remains essentially in a fixed position as the carrier rotates from horizontal movement past the operator station to vertical movement up toward the sorting level. An automatic loading device is provided to deposit envelopes into the carriers during this transition when the lip of the carrier is essentially stationary.

This automatic load mechanism includes a conveyor section which receives the envelope. The envelope is then deposited onto a slinger which moves the envelope into position against a gate. An envelope reader such as a bar code reading device is positioned adjacent the gate to read an envelope code. An envelope sensor is also positioned to detect the presence of envelopes positioned adjacent the gate and envelope reader. When the gate opens, the slinger propels the envelope onto one of several pallets. These pallets are rotatably mounted on a loading wheel and are abruptly tilted to slide the envelope into a carrier as the carrier is rotating from horizontal to vertical movement.

The data processing circuitry of the present invention does not directly govern the positioning of the conveyor but merely has control to turn the conveyor on and off. Rather, an encoder mounted on the conveyor drive generates signals which represent increments of one half inch of carrier travel. Additionally, a light source and detection pair interfaced to the data processor is used to detect movement of the carriers past a fixed position. As each envelope is loaded into the sorting apparatus, it is assigned destination and distance information in the data processor which determines when the envelope will be dropped. This information is updated to account for movement of the carrier and the carrier is opened to release the envelope into the desired drop chute and routed to one of the bins.

BRIEF DESCRIPTION OF THE DRAWINGS

FIG. 12 is a flow chart of the data processor program.

FIG. 13 is a diagram of the data processor interface electronics.

DETAILED DESCRIPTION OF THE PREFERRED EMBODIMENT

Figure 1:
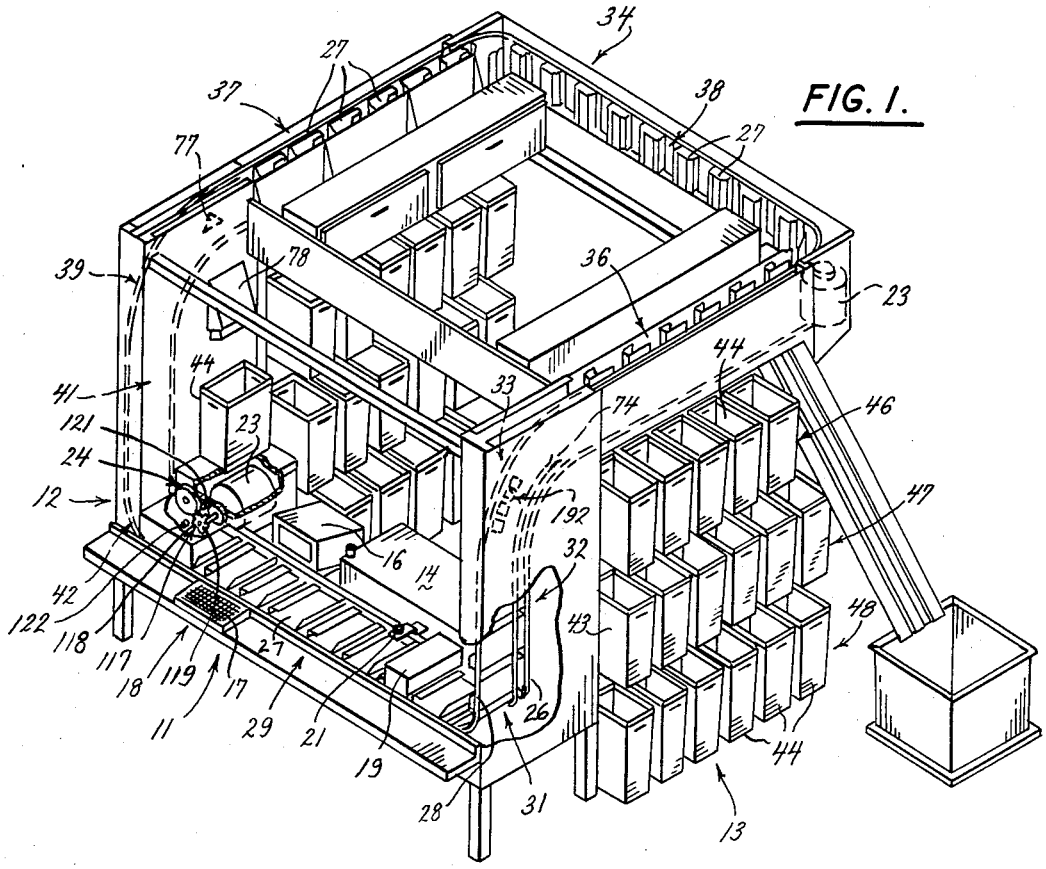
FIG. 1 is a perspective view of a sorting apparatus according to the present invention.

As illustrated in FIG. 1, the sorting apparatus of the present invention includes three main subsystems: the computer control system 11, a motion-imparting conveyor or conveyor mechanism 12 and a plurality of unloading locations which have receiving and guiding means or drop chute assemblies 13. The computer control system 11 controls operation of the sorting apparatus and includes a microprocessor based data processing means or unit 14 and associated interface electronics 15 (shown in block form in FIG. 13), a computer monitor 16 for displaying information, a keyboard 17 positioned at an operation station 18 for manual entry of information and selection of functions to be performed, an optical scanning and decoding system 19 such as a bar code reader for automatically reading information on envelopes contained within the carrier. An envelope sensor 21 is provided adjacent the bar code reader 19 to detect the presence of an envelope in the conveyor mechanism 12 and a plurality of other sensors discussed in greater detail below are provided by which the control circuitry can determine and control the status and function of the sorting apparatus.

Figure 2:
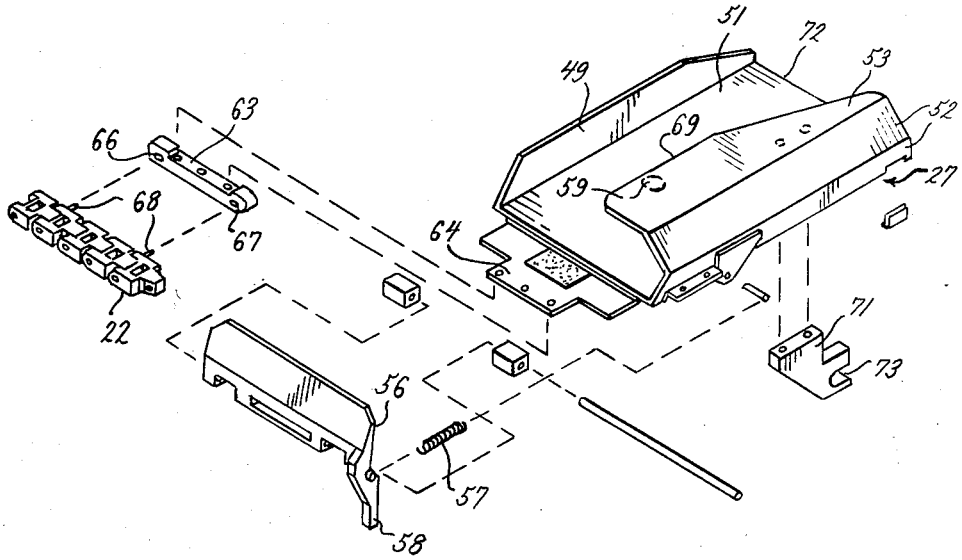
FIG. 2 is an exploded, perspective view of a carrier according to the present invention.
Figure 3:
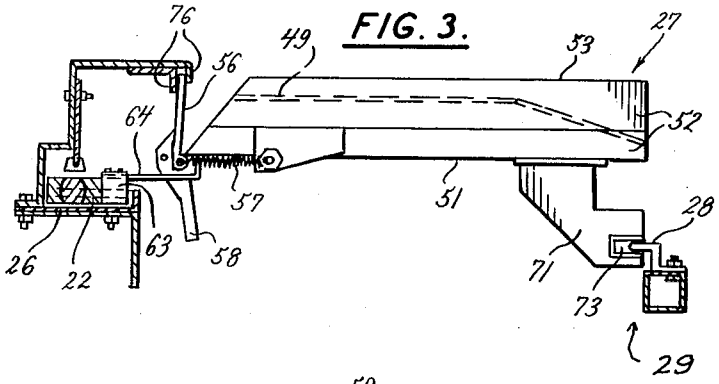
FIG. 3 is a partially sectional side elevation of the carrier of FIG. 2.
Figure 4:
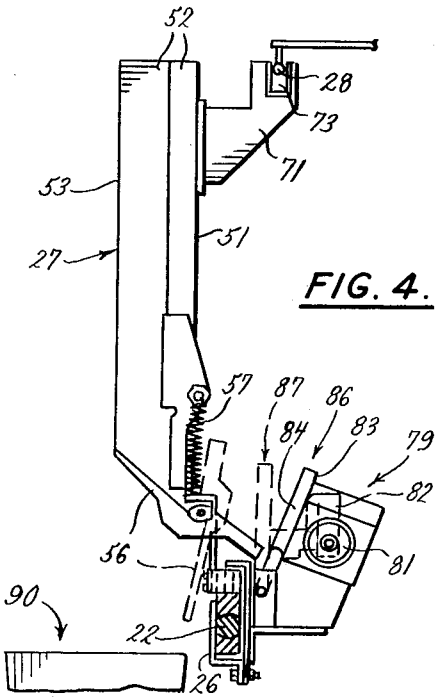
FIG. 4 is a partially sectional side elevation of a carrier and release mechanism according to the present invention.

The conveyor mechanism 12 includes a track-mounted drive chain 22 best shown in FIGS. 2–4. A pair of drive motors 23 are connected to the drive chain by means of a driver train 24 which circulates the chain around a track 26. A plurality of pocket-type means or carriers 27 are attached to the drive chain and are repeatedly circulated through the sorting apparatus thereby. In cooperation with a guide bar 28, the chain 22 moves the carriers 27 from a lower level 29 in which the carriers are disposed in a generally horizontal plane through a low radius ninety degrees curved section 31 of the conveyor path up a vertical ascending section 32 in which the carrier extends vertically with one side up. The carriers are then rotated through another ninety degrees section 33 to a vertical position. The carriers are then circulated along the upper level 34 which includes right and left sections 36, 37 connected by a rear section 38, whereby the conveyor has a plurality of turns. The carriers are then returned to their horizontal position in the lower section 29 by a ninety degrees section 39, a descending vertical section 41 and a low radius ninety degrees section 42 of the conveyor path.

Still referring to FIG. 1, the drop chute assembly 13 includes a plurality of drop chutes 43; and it supports six bins 44. The bins 44 are mounted adjacent to the drop chutes 43 on three levels 46, 47, 48 with two bins 44 mounted on opposite sides of the drop chute 43 at each level 46, 47, 48, whereby each unloading location has a plurality of bins or article-receiving receptacles grouped transversely of the conveyor path. The drop chutes 43 include means for receiving an envelope from a carrier 27 and diverting it into the proper bin 44 as described below.

As shown in FIGS. 2–5 each of, the carriers 27 of the present invention has a long axis and a short axis in plan view, has the long axis thereof parallel to the conveyor path, is enclosed on three sides, 49, 51, 52, and includes a partial front cover 52 which extends across approximately half the width of the carrier 27 and terminates in a lip 69 which extends along the center line of the carrier 27 to allow for loading at a loading location and for subsequent scanning of a bar code or other machine readable information on the envelope. An elongated closure or door 56 is pivotably mounted to the bottom of the carrier 27 and is maintained in place by a spring 57 which biases the door 56 into either a fully closed or fully open position. A trip lever 58 extends from the door 56 and is used to move the door between its open and closed positions. The construction of pocket-type carrier is such that it freely receives and loosely holds, but substantially encloses each article supplied to it, and also freely releases the articles for gravity-induced fall away.

Figure 11:
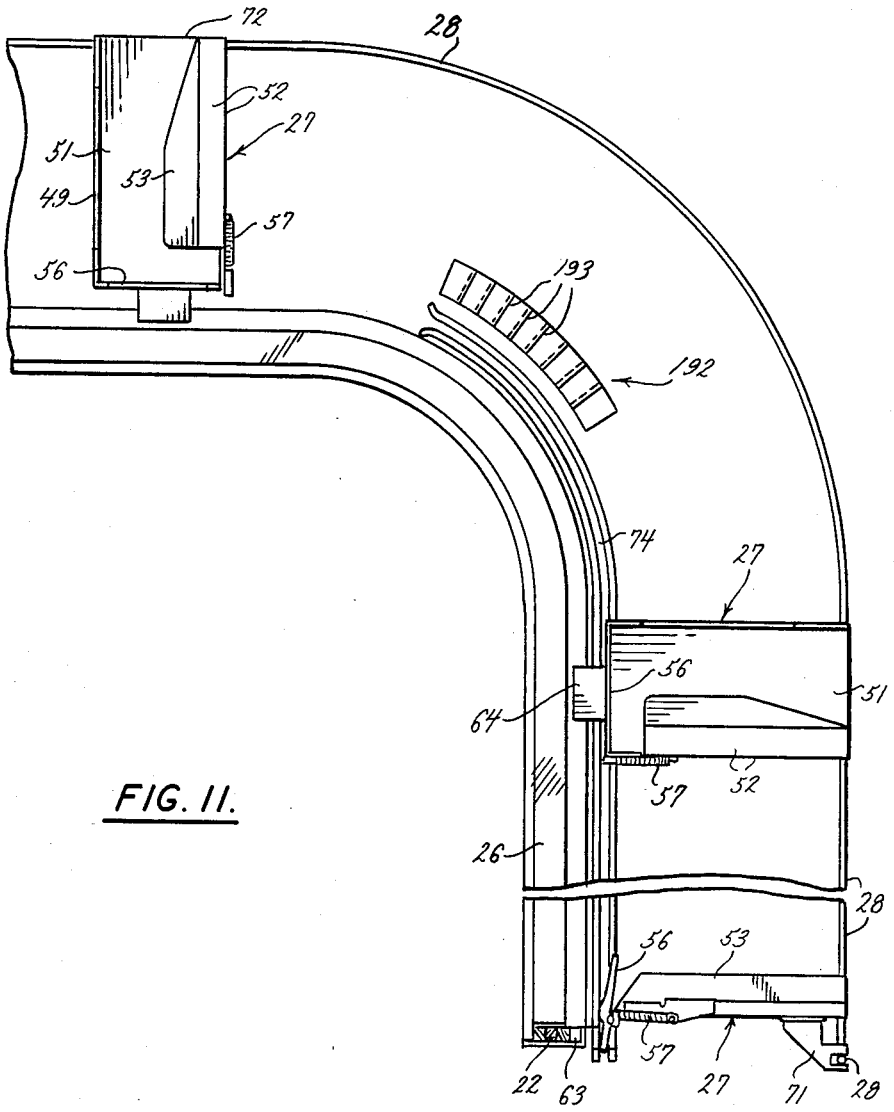
FIG. 11 is a partial side elevation of the sorting device of FIG. 1 with parts broken away.

The back 51 of the carrier 27 also includes an aperture 59 approximately in its center which is used in conjunction with the envelope sensor 21 to determine whether the carrier 27 contains an envelope. This sensor 21 comprises a light source 61 positioned beneath the lower level 29 of the conveyor mechanism 12 and a light detector 62 positioned to receive light from the source 61 through the aperture 59 when the empty carrier 27 is in position. The carrier 27 is connected to the chain 22 by means of a mounting block 63 which attaches to a tab 64 extending from the bottom of the vertical axis of the carrier 27. This mounting block 63 includes two apertures 66, 67 for receiving drive pins mounted on the drive chain 22 as illustrated in FIGS. 3 and 4. One of these apertures 66 is elongated such that changes in distance between the two pins as occur during traversal of the curved sections 31, 33, 39, 42 of the chain track are accommodated. As shown in FIGS. 3 and 4, this mounting block 63 is positioned beside the chain 22 in the chain track 26 which has the form of an elongated chain-confining enclosure, as shown by FIGS. 3, 4 and 11. The tab 64, which is the sole securement of carrier 27 to the conveyor, attaches to the block 63 through an open section of the chain track 26. The pins 68 attached to the chain 22 prevent the mounting block 63 from moving upward through the open section of the chain track 26. The block 63 and hence the vertical axis of the carrier is maintained perpendicular to the path of travel of the chain 22 by its sliding engagement with the lip of the carrier track 26, while the horizontal axis of that carrier is maintained parallel to that path.

Referring next to FIGS. 1, 2 and 4, the carrier is supported against rotation about the chain by means of a guide block 71 which attaches to the back 51 of the carrier 27 adjacent its upper edge 72. This guide block 71 forms a notch 73 which engages the guide rail 28, best illustrated in FIGS. 1 and 3–5.

Figure 5:
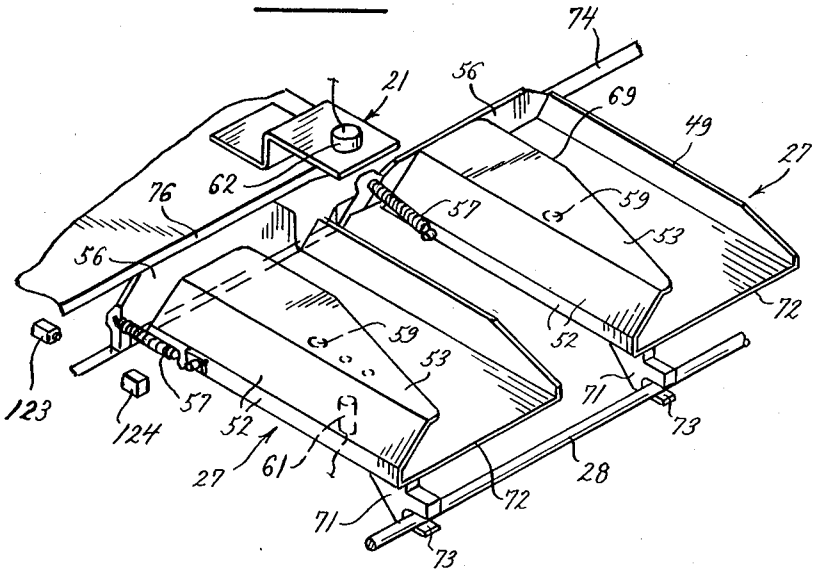
FIG. 5 is a perspective view of carriers positioned adjacent the operator station with parts broken away.

As illustrated in FIGS. 3–5, various mechanisms are positioned along the length of the track for operating the carrier door 56 or positioning it in other than a fully open or fully closed position. As illustrated in FIG. 5, the door 56 may be partially opened by an elongated groove-type cam 74 which receives the depending trip lever 58 and a track 76 which receives the upper lip of the door 56. The elongated, groove-type cam 74 extends along the lower section of the carrier path 29, through the curved section 31 up the vertical section 32 and terminates after the upper ninety degrees section 33 as discussed in connection with FIG. 10 to maintain the door 56 in a partially opened configuration. In addition, a cam 77, shown in FIG. 1, can be positioned along the path of the conveyor 12 to engage the trip lever 58 and move the door 56 from its closed to its open position. Thus, all doors are automatically positioned in an opened configuration just ahead of the descending ninety degrees section 39 of the carrier path by a cam 77 positioned to engage the trip lever 58 of any unopened carrier 27 to release any envelopes therein down the return chute 78 to the operator station 18.

In order to perform a sorting function, the carrier door 56 must be selectively opened above the proper drop chute assembly 13. As illustrated in FIG. 4, this is accomplished by means of a releasing means or release assembly 79 positioned adjacent the track 26. This release assembly 79, which serves as an opening means for the door 56, comprises a rotary actuator 81 to which is connected an actuator arm 82. A trip arm 83 is spring-biased into engagement with the actuator arm 82 and includes a ramped face 84 which slopes upward toward the upper edge 72 of the carrier 27 in the direction of chain travel. This trip arm 83 is moveable by the actuator 81 between a first, retracted position 86 in which a carrier 27 may be moved past the release assembly 79 without engaging the trip arm 83 and a second, extended position 87 in which the trip lever 58 of the carrier door 56 will engage the ramped face 84 of the trip arm 83 as it is moved past the release assembly 79. The drop chutes 43 serve as receiving and guiding means at the unloading locations and are positioned below the level of the pocket-type carriers 27, as the releasing means 79 effect release of the articles from the carriers 27, to receive the selected articles after they have started to fall away from carriers 27, and to selectively apply laterally directed, receptacle-selecting guiding forces to selected ones of the articles.

Figure 6:
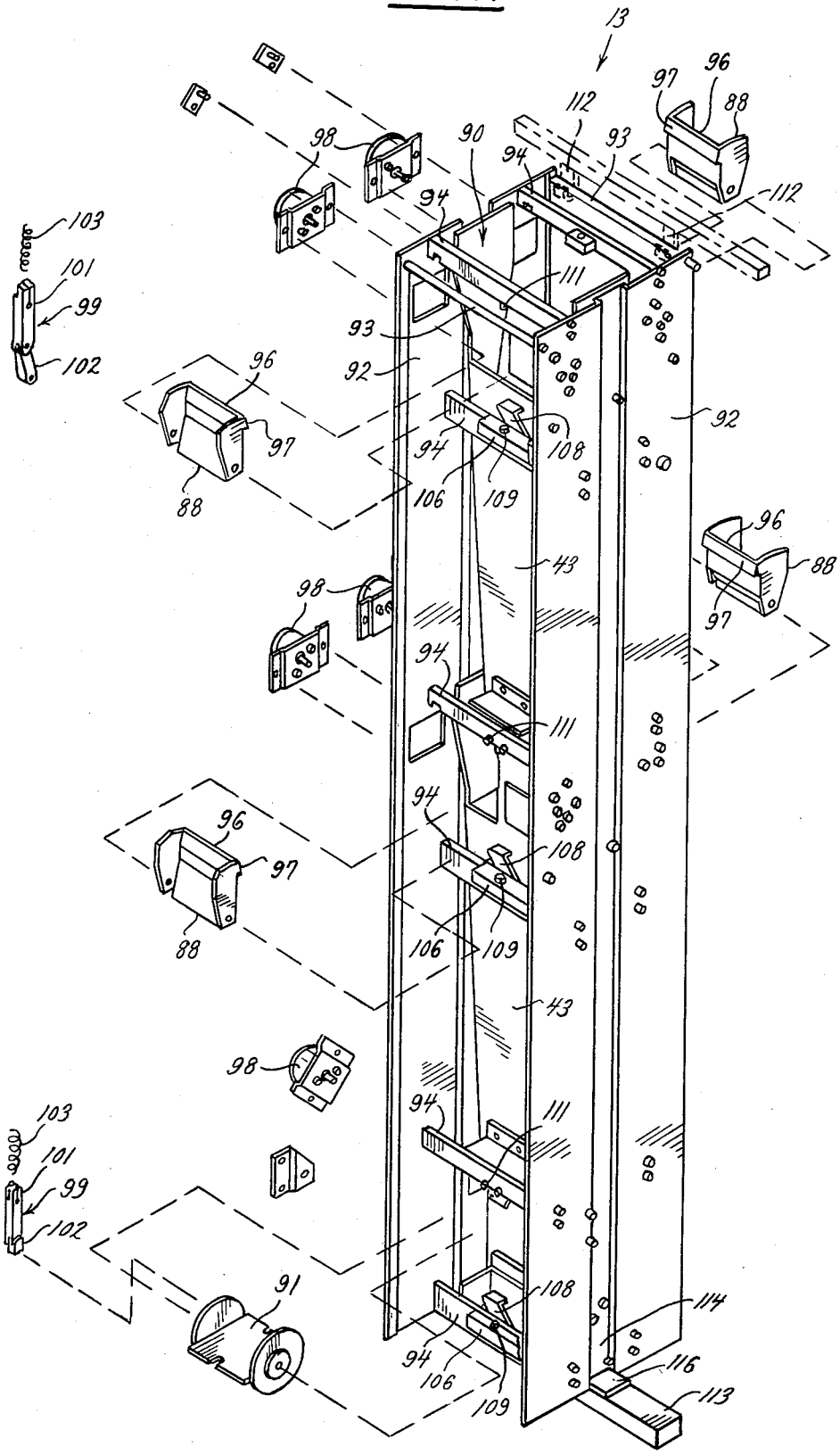
FIG. 6 is a partially exploded view of a drop chute according to the present invention.
Figure 7:
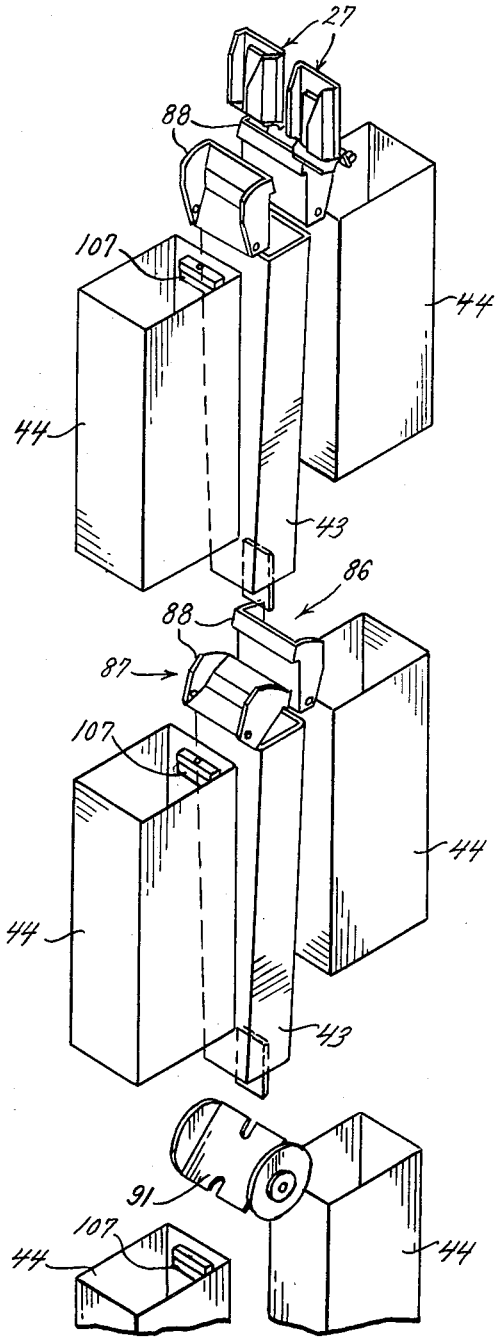
FIG. 7 is a schematic perspective view of a drop chute according to the present invention illustrating sorting of an envelope into one of the bins.

FIG. 6 illustrates a drop chute assembly 13. As best shown in FIGS. 6 and 7, this drop chute 43 defines a vertical passageway 90 through which an envelope may be dropped from a carrier 27. This passageway is formed by four diverter gates 88 disposed in pairs on opposite sides of the passageway and by two tapered chutes 43. The passageway terminates at a lower diverter gate 91. The diverter gates 88, 91 and the chutes 43 are positioned between and supported by a pair of side panels 92 which are connected, inter alia, by two mounting rods 93 which extend between the upper corners of the opposite side panels 92. Additional cross members 94 are provided for mounting each of the six bins 44.

The diverting means or diverter gates 88, 91 are pivotably mounted to the side panels 92 in opposed pairs at the upper ends of the tapered chutes 43. The upper edges 96 of the diverter gates 88 include an inwardly and downwardly sloping guard 97 to direct envelopes falling past the diverter gates back into the center of the next-lower drop chute 43. The tapered chutes 43 are likewise of course, tapered to guide the envelopes back toward the centers of those chutes. Accordingly, the likelihood of the envelope failing to enter the proper drop chute or becoming stuck within the drop tube is reduced. A rotary actuator 98 is mounted adjacent each of the diverter gates 88 and is connected to the respectively associated diverter gate by means of a jointed arm 99 which is pivotably attached to the diverter gate 88 at a position remote from its pivotable attachment to the side panels 92. This arm 99 is designed to load the rotary actuator according to its torque curve. Since the rotary actuator typically has a low initial torque which increases with increasing rotary movement, the arm 99 is attached to the diverter gate in a configuration which is slightly bent past center. As the actuator rotates, the arm 99 straightens such that the upper and lower links 101 and 102 are lined up. The arm 99 then bends the other way and begins moving the gate from its retracted position to its advanced position wherein the upper edge 96 is positioned in the vertical passageway 90, as indicated at the top of FIG. 7. A relatively large angular movement of the rotary actuator 98 thus produces only a small pivotal movement of the diverter gate 88 at first. As the diverter gate 88 pivots further into the passageway, the upper link 101 is rotated to an increasingly great angle from the lower link and accordingly less angular deflection of the rotary actuator 98 is required to achieve a given deflection of the diverter gate 88. The increased torque of the rotary actuator is able to handle the increased loading and thus moves the diverter gate 88 into position quickly. A spring 103 is provided to pull the diverter gate 88 back into its retracted position.

The rotary actuator 98 is deactuated when the diverter gate 88 is in its retracted position, and hence a gate 88 could be bumped inward toward the passageway. The past-center bend in the arm 99 prevents any such movement, however, since such movement of the diverter gate 88 would cause further past-center bending of the arm 99 and backward rotation of the actuator.

A pair of micro switches (not shown) are associated with each diverter gate. These micro switches close, respectively, when the diverter gate is in its advanced and retracted positions and are used by the computer control system 11 to determine the positioning of the diverter gate 88.

The lower diverter gate 91 differs from the upper diverter gates 88 in that any envelope reaching the bottom of the lower tapered chute 43 is destined for one of the two bins 44 on the lower level 48. Accordingly, this diverter gate 91 need not withdraw to permit envelopes to pass thereby but must merely divert the envelopes into one or the other of the two lower bins 44. This diverter gate is thus mounted beneath the lower chute 43 and is moved between positions for diverting envelops into one or the other of the two lower bins 44 by means of a rotary actuator 98 and jointed arm 99 as described above. The diverter gate 91 is biased to divert envelopes into one of the two bins 44 by means of a spring 103.

Bins 44 are mounted on the drop chute assemblies 13 by means of hooks 106. As best illustrated in FIGS. 6 and 7, these hooks 106 extend through a rectangular aperture 107 adjacent the upper edge of the bin 44. When a bin 44 is positioned on the hook 106, the upper edge of the bin engages a shield 108 which is pivotably mounted to the cross member 94 and pivots the shield 108 towards the side of the adjacent drop chute 43. Removal of the bin 44 allows the shield 108 to tilt away from that side. A light source 109 is mounted on each of the hooks 106 and is directed upward toward a light detector 111. When a bin 44 is mounted on the mounting hook 106, this light source 109 is positioned within the bin 44 adjacent the upper lip thereof and the shield 108 is moved out of the path between that light source and detector, 111. Removal of the bin allows the shield 108 to tilt away to again break the beam of light between the light source and detectors 109, 111. In addition, should the bin 44 become so full that an envelope cannot fully slide into the bin 44, the beam of light between the associated light source and detector 109, 111 will be broken. Removal of the bin 44 allows the shield to drop forward, again breaking the beam of light between the source and detector 109, 111. The light source and detector 109, 111 associated with each bin 44 can thus be used to detect whether the bin 44 has been removed or is full.

The drop chute assemblies 13 are mounted in place on the sorter by means of a pair of hooks 112 which receive one of the mounting rods 93. The drop chute assembly 13 is lifted onto the hooks and simultaneously positioned above a lower frame member 113 so that a recess 114 in the side panels 92 is positioned to receive an indexing tab 116. The drop chute assembly 13 is then lowered into position on the lower frame member 113 and hooks 112.

As shown in FIG. 1, the carriers are circulated along their track by means of a pair of drive motors 23. In order to keep track of movement of the conveyor chain, an encoder mechanism 117 is connected to the chain drive. This encoder mechanism includes a disc 118 mounted to a shaft in the drive system. A plurality of slots 119 extend inward from the periphery of the disc 118 at uniform spacings about its circumference. A light source and detector pair 121, 122 are positioned on opposites side of this disc 118 such that light alternately passes through the slots 119 and is blocked by the solid portions of the disc as the disc rotates. The light detector senses these alternate blockings and unblockings of the light source and is interfaced to the computer by known means. A sufficient number of slots 119 are provided in the disc 118 to produce a signal for each ½ inch of carrier movement.

In addition, as shown in FIG. 5, a light source and detector pair 123, 124 are positioned in the path of the carriers 27 adjacent the data processing unit 14 and the guide 74. The light beam produced by this source-detector pair 123, 124 is blocked by the depending trip lever 58 of each carrier 27 as it passes through that beam and thus produces a signal indicative of carrier position.

Figure 8:
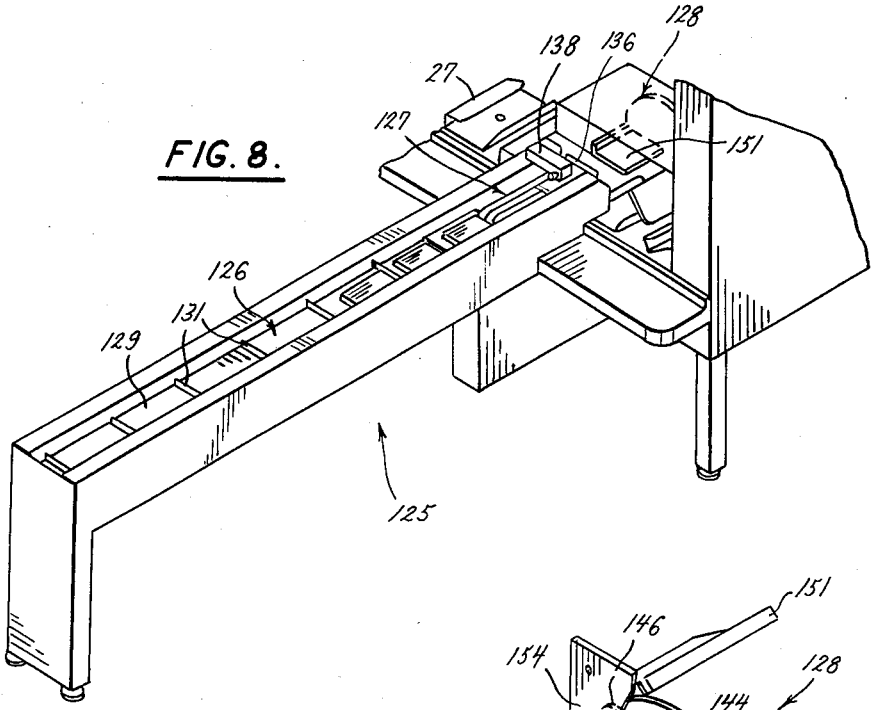
FIG. 8 is a perspective view of a device according to the present invention for automatically loading envelopes into the carriers of the sorting device with parts broken away.
Figure 10:
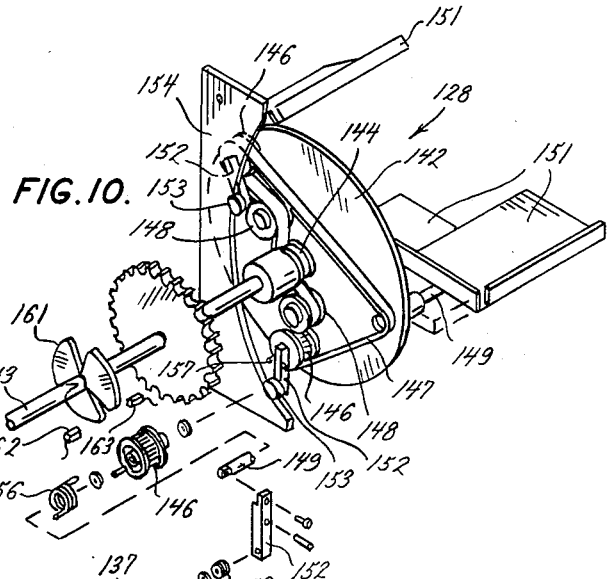
FIG. 10 is a partially exploded perspective view of the loading device of FIG. 8 with parts broken away.
Figure 9:
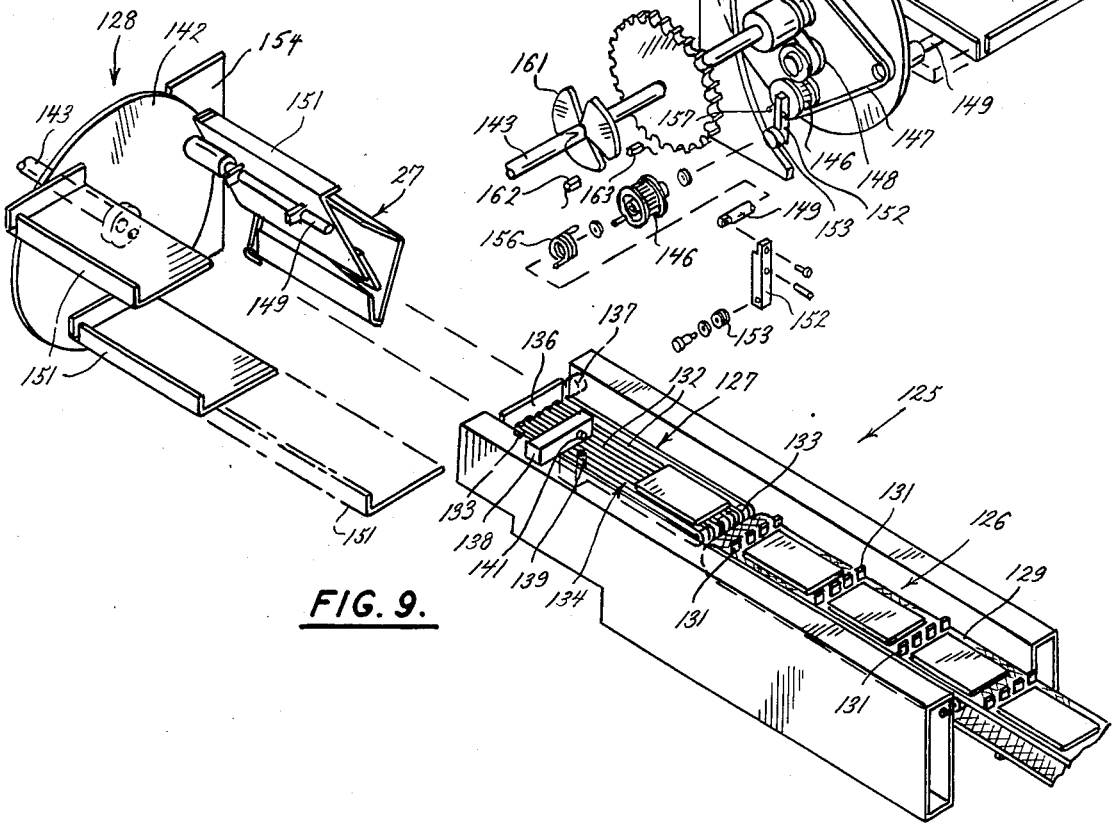
FIG. 9 is a perspective view of the loading device of FIG. 8 with parts broken away.

It is difficult, if not impossible, for a single operator to insert envelopes into the carriers 27 at a rate of several thousand envelopes per hour. Accordingly, an automatic loading mechanism 125 may be provided which cooperates with the sorting mechanism to load envelopes into the carrier. As best illustrated in FIGS. 8–10, such an automatic loading apparatus comprises a conveyor assembly 126, a slinger assembly 127 and a loading carousel 128. The conveyor mechanism 126 comprises a belt conveyor 129 to which are attached a plurality of vertically extending dividers 131 that accommodate articles, each of which has a long axis and a short axis in end view, as shown by FIGS. 8 and 9. The spacing between dividers 131 is chosen to be sufficient to receive a single envelope or other article. The conveyor assembly 126 is connected to the drive motor 23 by a drive system (not shown) which drives the belt at a speed such that the conveyor delivers one envelope to the slinger assembly 127 for each carrier 27 which passes the automatic loading device.

The slinger assembly 127 is positioned to receive envelopes from the conveyor mechanism 126. This slinger mechanism comprises a plurality of belts 132 extending around two rollers 133. These rollers are driven by an electric motor at a relatively rapid rate of speed. The belts 132 are of generally circular cross-section and are maintained in position along the length of rollers 133 by a plurality of grooves in the rollers which conform to the shape of the belts 132. These belts 132 and rollers 133 cooperate to form the slinger conveyor 134.

Envelopes are retained on the slinger conveyor during operation by means of the slinger gate 136. This gate is positioned between the end of the slinger conveyor 134 and the loading carousel 128 and is operated by means of a rotary actuator 137.

A conventional bar code reader 138 is positioned over the slinger conveyor 134 for reading bar codes on the envelopes. In addition, a light source and detector pair 139, 141 is mounted beside the bar code reader 138. This light source and detector pair 139, 141 projects a beam of light between the belts 132 of the slinger conveyor 134 to detect the presence of an envelope beneath the bar code reader 138. This bar code reader 138 is used in place of the bar code reader 19 illustrated in FIG. 1. The light source and detector pair 139, 141 likewise replaces the light source and detector pair 61, 62 for sensing the presence of envelopes on sorters equipped for automatic loading.

The loading carousel 128 is designed to receive envelopes from the slinger assembly 127 and deposit them in carriers 27 so the long axis of each envelope (in end view) is parallel to the conveyor path. This carousel comprises a mounting plate 142 which is mounted on a shaft 143. The shaft 143 is rotatably mounted to the frame and is connected to the drive motor 23 of the conveyor mechanism such that it rotates the mounting plate $\frac{1}{3}$ of a revolution for each carrier 27 which passes the carousel 128 of the automatic loading mechanism. A fixed pulley 144 is mounted to the frame concentrically with the shaft 143 and three peripheral pulleys 146 of the same diameter are rotatably mounted to the mounting plate 142. These pulleys 146 are driven by a toothed belt 147 which passes around the fixed pulley 144, the three pulleys 146 and a pair of idler pulleys 148. Since the diameter of the peripheral pulleys 146 is the sme as that of the fixed pulley 144, these pulleys 146 rotate once for each revolution of the mounting plate 142.

A shaft 149 is rotatably mounted through each of the peripheral pulleys 146. The shaft 149 extends through the mounting plate 142 and supports an envelope pallet 151 which extends outward from the mounting plate 142. A cam follower arm 152 is connected to the other end of the shaft 149. This cam follower arm 152 includes a roller 153 at its distal end for engaging a cam 154. The follower arm is biased by means of a spring 156 into engagement with a stop 157 mounted on the pulley 146. When the arm 152 is in engagement with this stop, the pallet is rotated to a horizontal position. Since each of the peripheral pulleys 146 are driven by the fixed pulley 144 to rotate once for each revolution of the mounting plate 142, the pallets are thus maintained in a horizontal position so long as the follower arm 152 remains biased against the stop 157.

The cam 154 is positioned behind the mounting plate 142 in position to engage the rollers 153 on the cam follower arms 152 as the mounting plate 142 is rotated. A slotted disc 161 is mounted on the shaft 143. A light source and detector pair 162, 163 are mounted on opposite sides of the disc and provide a signal to energize the rotary actuator 137 to open the slinger gate 136 as each pallet 151 is rotated into position in front of the slinger assembly 127.

Referring next to FIG. 1, the carriers 27 in the course of operation are transported from left to right past the monitor and keyboard 16, 17 along the lower level 29 at which point the path of the conveyor rotates ninety degrees and moves the carriers vertically up to the upper level 34. The carriers are then rotated ninety degrees into a vertical position at the upper level 36. During this transition from the lower level to the upper level, an envelope may fall forward and a portion thereof may extend out of the carrier 27 through the open portion of the side 52 of that carrier. As set forth in FIG. 11, such a problem is eliminated by means of a curved guide 192 which engages the corner of any envelope projecting from a carrier 27 and moves it back within the confines of the carrier 27. This guide, which is intermediate the viewer and the path of movement of the carriers 27 in FIG. 11, includes a plurality of ridges 193 which vibrate the envelopes sufficiently as it traverses them to ease their sliding back into the carrier 27. The elongated groove-type cam 74 extends along the path of the carriers 27 and engages the trip lever 58 to maintain the carrier door 56 in a partially opened state while the envelope is in engagement with the curved guide 192. By the time the trip lever 58 moves beyond the end of the cam 74, the envelope will have been forced back into the carrier, and the cam 74 will allow the carrier door 56 to close completely.

A release assembly 79, which is shown in FIG. 4 is positioned adjacent the end of the curved guide 162 192, which is shown in FIGS. 1 and 11, to selectively release envelopes into a chute which is provided beneath the path of the conveyor and which is denoted by the numeral 90 in FIG. 4. This chute conveys envelopes released from carriers 27 by the associated release mechanism 79 back to the operator station. As best shown in FIG. 1, a fixed release cam 77 is provided in the carrier path just ahead of the ninety degree curved section 39 to engage the trip levers 58 of all carriers as they pass. All closed carriers 27 are thus opened by the release cam 77 as they approach the ninety degree curved section 39 where they begin their descent to the lower level. A chute 78 is provided to return envelopes, released from the carrier 27 by the release cam, to the lefthand-most bin 44 in FIG. 1, and thus to the operator station. That bin serves as a return receptacle for all articles which are loaded into carriers 27 but are not released prior to the time those carriers reach the release cam 77. The release mechanism 79, which is positioned adjacent the exit of the curved guide 192, is not shown in FIG. 11; and the chute, which will receive envelopes that are released from carriers 27 by actuation of that release mechanism, also is not shown. However, the ramped face 84 of that release mechanism will have about the same spacings, from the top and front of the sorter apparatus of FIG. 1, which the release cam 77 has. Also, the chute, which will receive envelopes that are released from carriers 27 by actuation of that release mechanism, will have about the same spacings, from the top and front of the sorter apparatus of FIG. 1, which the chute 78 has.

Referring to FIG. 1, the sorting apparatus of the present invention operates as follows. An operator sitting adjacent the keyboard 17 inserts envelopes into the carriers 27 as they pass in front of him. The conveyor mechanism 12 moves the carriers 27 along the lower level 29 past the sensor 21 and the bar code reader 19. The envelope and carrier then rotate ninety degrees from a horizontal position to a vertical position. As the carriers approach the upper level 34 they are again rotated ninety degrees to an upright position as they are carried past the curved guide 192 which urges any envelopes which may be protruding from the carrier 27 back into the confines of the carrier 27. After the trip lever 58 on the carrier door 56 leaves the elongated groove-type cam 74, the spring 57 will move that door to fully-closed position. The carrier 27 and envelope are then carried past the release assembly 79 position adjacent the guide 192 which is illustrated in FIG. 11. This release assembly is actuated if the envelope sensor 21 has detected an envelope in the carrier but the bar code reader 19 has been unable to read the bar code on the envelope for any reason. As the carrier moves past this actuated release assembly 79, the trip level 58 on the carrier door 56 engages the ramped face 84 of the extended trip arm 83 and moves the carrier door 56 from its closed position to its open position. The envelope then drops out of the bottom of the carrier 27 and into the chute which conveys it back to the operator station 18. The operator may then use the keyboard to enter the proper code number and insert the envelope into a carrier. The data processing unit 14 then disables the bar code reader 18 and assigns the code entered on the keyboard 17 to the first carrier 27 which contains an envelope as determined by the envelope sensor 21.

If the data processing unit 14 received a bar code number from the bar code reader 19, the carrier continues traversing the upper level 34 until such time as it approaches the assigned drop chute assembly 13. At the proper moment, the release assembly 79 associated with the proper drop chute assembly 13 is energized to open carrier door 56 and release the envelope to fall into the drop chute assembly 13. Referring next to FIGS. 1, 6 and 7, the carriers are moving at an appreciable velocity as they pass the top of the drop chute assemblies 13. Accordingly, the release assembly 79 is positioned to open the carrier 27 before it reaches a position above the drop chute assembly 13. By the time the envelope reaches the level of the top of the drop chute assembly 13 its lateral velocity has carried it over the drop chute assembly 13 so that it enters the drop chute assembly 13 and begins its downward transit therethrough.

If the envelope is destined for one of the upper two bins 44 associated with the upper drop chute 43 of the drop chute assembly 13, the diverter gate or diverter means 88 associated with that bin 44 is moved into its extended position by the associated rotary actuator 98, thereby providing selective directing of an article transversely of the conveyor path. The envelope is then guided into the appropriate bin 44.

The time required for an envelope to fall past the first two pairs of diverter gates and bins 44, 88 may be sufficiently great relative to the speed of movement of the carriers that a second carrier could be in position to drop an envelope before the envelope dropped from the first carrier 22 has reached the lower diverter gate 91. In such instance, if the drop chute assembly 13 were configured to receive only a single envelope at a given time, the diverter gate 91 may have been returned to its original position before the envelope reaches it. The envelope could thus be diverted into the wrong one of the lower bins 44. The possibility of error increases with increasing length of the drop chute assembly 13, increased carrier speed and increased number of bins and diverter gates associated with each drop chute assembly 13. In order to prevent such errors from occurring, the data processing unit 14 delays operation of the lower diverter gate 91 to account for the amount of time required by an envelope to fall from a carrier to that level. Accordingly, one of the upper diverter gates 88 may be energized to divert a second envelope before the lower diverter gate 91 has diverted a first envelope into the proper bin 44.

During the sorting process, of course, the bins are likely to fill at different rates. Accordingly, one or more of the bins 44 may become full before sorting is complete. In order to maintain the high rate of speed of the sorting process the light source and detector pair 109, 111, which serve as sensing means to sense the ability of a bin 44 to accept further articles, and which are mounted on the drop chute assemblies 13, are positioned such that the beam between the source detector pair 109, 111 is blocked when an envelope is diverted into a full bin. Since the light source 109 is positioned below the upper lip of the bin 44, the beam will be blocked before the bin is so full that envelopes spill onto the floor. The data processing unit then ceases routing envelopes to the full bin 44. If the bar code associated with the full bin is also associated with a preprogrammed alternate bin or back-up receptacle 44, the envelopes will be routed thereafter to such alternate bin 44, whereby the source detector pair 109, 111 and the data processing unit serve as a means to route articles, that are intended for a full bin 44, to a back-up receptacle. In the event that no such alternate bin 44 has been designated, or all such alternate bins are likewise full, or have been removed, the envelope is returned to the operator station as described below.

A bin 44 may also be removed during the sorting process before it becomes completely full. In such instance, removal of the bin allows the shield 108 to drop forward breaking the light beam between the source detector pair 109, 111. Any envelopes coded to be delivered to such a removed bin 44 will be delivered to an alternate bin, if any, or returned to the operator station.

If the envelope is not destined for one of the bins on the right side 36 of the sorter mechanism, it is carried past the drop chute assemblies 13 associated with these bins 44. The carrier 27 then makes a ninety degrees turn, traverses the back 38 of the sorter mechanism, makes another ninety degrees turn and is conveyed forward toward the operator station and past another group of drop chute assemblies 13.

Still referring to FIGS. 1, 6 and 7 a drop chute assembly 13 may become inoperative due to a failure, for example, of one of the rotary actuators, jamming of the diverter gates 88, 91 or other reasons. The apparatus is designed to permit servicing of a drop chute assembly 13 during the sorting operation. In such instance, it is necessary only to demount the bins from the drop chute assembly 13 and lift the drop chute assemblies 13 out of engagement with the mounting hooks 112 and index tabs 116. The wires running from the actuators 98 and light source and detector pairs 109, 111 terminate in jacks which can be disconnected to permit removal of the drop chute assembly 13. A replacement drop chute assembly 13 can then be installed in place of the defective or jammed drop chute assembly 13 and sorting can recommence. Any envelopes destined for the defective drop chute assembly, of course, are returned to the operator station while the drop chute assembly is out of service as described below.

If for any reasons (such as failure of the release assembly 79, removal of the bin or drop chute assembly or filling of the bin) the envelope is not released from its carrier 27 by the time it has passed the last of the drop chute assemblies 13, the carrier moves past the release cam 77 which releases any envelope contained within the carrier 27 down the return chute 78 to the operator station. When the drop chute assembly 13 is repaired or the bin emptied, these envelopes can then once again be loaded into carriers 27 and sorted. The empty carriers 27 are then returned to the operator station 18 for reloading.

The sorter is easily expandable. Additional sets of twelve drop chute assemblies 13 may be mounted in line with the first set of twelve drop chute assemblies and the transverse rear section 38 moved back. When this is done, the spacing of the carriers is maintained such that a carrier 27 will be in position over each of the first drop chute assembly 13 of each set of six drop chute assemblies 13 at the same time. Subsequently, a carrier 27 will be in position over the second drop chute assembly of each set, and so on up to the twelfth drop chute assembly 13. In order to increase the throughput of the sorting mechanism, the automatic loading device 125 may be used. Envelopes are loaded into the sorter using this device 125 as follows. An operator positions envelopes on the conveyor belt 129 between the dividers 131.

Since the conveyor belt 129 is driven by the conveyor drive mechanism 12, one carrier passes the automatic loading device 125 for each divider 131 that passes the operator. Accordingly, a one for one correspondence between carriers 27 and envelopes is established. Envelopes are carried by the conveyor 129 to the slinger conveyor 134 which quickly carries the envelope beneath the bar code reader 138, between the light source and detector pair 139, 141 and into engagement with the slinger gate 136. The data processor 14 receives the bar code from the bar code reader 138 together with an indication from the light source and detector pair that an envelope is present and will be loaded on to the next pallet 151. The pallets 151 are close to the left-hand ends of endless belts 132 of the slinger conveyor 134, as shown by the dotted-line positions of one of those pallets in FIG. 9. If the bar code reader 138 fails to detect a valid bar code (which may occur if the envelope is torn or turned upside down,) the source and detector pair 139, 141 detects the presence of the envelope. The data processor 14 then assigns this envelope to be returned to the operator station 18 down the chute below the releasing assembly 79 adjacent the exit end of the groove-type cam 74 in FIG. 11. If the bar code reader detects a valid bar code, however, the data processor 14 selects the bin to which an envelope is to be delivered based on the bar code.

The slinger gate 136 operates in synchrony with the carousel 128 and opens when one of the pallets 151 moves into position in front of the slinger assembly 127. The gate 136 is then opened by the actuator 137 and the envelope is propelled by the rapidly rotating slinger conveyor 134 onto the pallet 151. The friction between the envelope and the moving slinger conveyor 134 is sufficient to accelerate the envelope rapidly once the gate 136 is opened.

As best shown in FIG. 8, the rotating carousel 128 is located adjacent the ninety degrees bend 31 in the conveyor path at which the carriers 27 are turned from horizontal movement to vertical movement. The height of the partial front cover 53 on the carrier 27 above the chain track 26 and groove-type cam 74 is approximately equal to the radius of curvature of the conveyor mechanism's path at this point. Accordingly, the carrier appears to pivot about the partial front cover 53 of the carrier 27 as it makes the transition from horizontal to vertical motion. At this point, the roller 153 on the cam follower arm 152 engages the cam 154 and rapidly tips the pallet 151 into the carrier 27. Pivoting of the carrier 27 to vertical movement and rotation of the carousel continue with the edge of the pallet 151 remaining in close proximity to the partial front cover 53 of the carrier 27. The cam 154 is shaped such that the edge of the pallet 151 is maintained over the course of the loading process in close proximity to the partial front cover 53 of the carrier 27 but is kept at a sufficient distance to avoid any mechanical interference between the pallet 151 and the carrier 27. Once the envelope has had sufficient time to slide from the pallet 151 into the carrier 27, the roller 153 moves out of engagement with the cam 154 to allow the pallet 151 to revert quickly to its normal horizontal position. This returns pivoting of the pallet 151 tends to flip the trailing edge of the sliding envelope into the carrier 27 and aids in the loading process.

The data processor 14, which may constitute any of a variety of available microprocessor systems, is interfaced in known manner to the light source and detector pairs 61, 62; 109, 111; 121, 122; 123, 124; and 139, 141; to the bar code reader 19; to the microswitches which sense the position of the diverter gates 88, 91; and to the actuators 81, 98; as well as to the drive motors 23 as illustrated in FIG. 13. The data processor 14 is thus capable of sensing the configuration of the machine as well as controlling its operation. The data processor 14 controls the operation of the machine as described below with specific reference to FIG. 12.

The first step 171 in operating the machine is issuing a start command to the data processor by means of the keyboard 17. On receiving this start command, the data processor 14 turns the conveyor on. In the next step 172 the data processor 14 begins monitoring the light source and detector pair 123, 124, (shown in FIG. 5) to determine if the trip lever 58 of a carrier 27 has broken the beam of light therebetween. The breaking of this beam results in a datum signal being sent to the data processor 14. The data processor continues monitoring the light source and detector pair 123, 124 for receipt of a datum signal. When such datum signal is received, the data processor 14 begins monitoring the light source and detector pair 61, 62 or 139, 141 depending on whether the sorting apparatus is configured for manual or automatic loading as set forth above. If an envelope is not present in this step 173 the data processor goes back to the step 172 of awaiting the receipt of a datum signal. If an envelope is present in this step 173, the data processor 14, in the next step 174, checks to determine if a bar code has been manually entered. If so, it is imperative that this bar code and the associated destination bin be assigned to the indicated envelope and associated carrier 27, accordingly the step 176 of monitoring the bar code reader 19, 138 to receive a bar code therefrom is bypassed. If no code has been manually entered, the data processor in the next step 176 monitors the bar code reader 19 or 138 to receive a bar code therefrom. If the sensors determine that an envelope is present in the step 173 but a bar code cannot be supplied by the bar code reader 19 or 138 in the step 176, a problem such as a defective bar code imprinting, a torn envelope, or some obscuring of the bar code on the envelope may exist. In any event, since the bar code reader 19 or 138 was unable to supply a bar code, the envelope cannot be delivered to the desired destination bin 44. Accordingly, all such envelopes and the carrier 27 which bear them are assigned a special destination code in the next step 177 which results in their being released from the carrier 27 by the release assembly 79 adjacent the exit end of the groove-type cam 74 in FIG. 11. The operator can then enter the desired code manually via the keyboard as set forth with respect to the previous step 174 and reload the envelope at which point the envelope will be delivered to the proper bin.

If the bar code reader 19 or 138 has sent a bar code to the data processor in the step 176, the data processor proceeds to the next step 178 of determining if the bar code is one of the bar codes stored in its memory. If the bar code is not found in memory, this envelope should not be sorted into any of the bins 44. Accordingly, the data processor 14 ignores any such envelope and returns to the step 172 of awaiting a datum signal. Since no destination bin 44 has been assigned to this envelope and the associated carrier 27, the envelope will bypass all of the drop chute assemblies 13. The carrier 27 will, of course, be opened when the trip lever 58 engages the cam 77, at which point the envelope will be released down the return chute 78 and returned to the operator.

If the bar code is found in memory in this step 178 or if a "no code read destination" was signed in the step 177, the next step 179 is to load a counter array with destination and distance information. This information includes the distance to the desired drop chute assembly 13 and information representing the desired bin 44 and any alternate bins 44 on that drop chute assembly 13 to which the envelope may be delivered. In order to allow time for the envelope to fall to a lower bin, this distance count is chosen so that the envelope will reach the bottom bin before the next carrier 27 is in position to release an envelope into the drop chute assembly 13. The counter array loaded in this step is capable of containing such information with respect to as many carriers 27 and envelopes as may be loaded in the sorter apparatus at any given time.

The next step 181 shown in FIG. 12 is an interrupt step. In this step, the data processor 14 decrements the distance values loaded into the counter array each time the encoder mechanism 117 completes a cycle of blocking and unblocking the light source and detector pair 121, 122 which indicates incremented movement of the conveyor mechanism 12. This step 181 and the following steps 182–189 are not truly sequential with the first portion of the program. Rather, as is the case with all interrupt steps 181–189, this step 181 is executed whenever another approximately one half inch of movement of the conveyor mechanism 12 has been completed. At this point, the encoder mechanism 117 sends a signal to the data processor 14 and the data processor executes the step 181 of decrementing the counters at that time. Execution of the program steps 171–179, whenever the data processor is executing the interrupt steps 181 –189, stops and then resumes as soon as this interrupt step 181 has been completed. In the next step 182, the data processor checks all of the distance values in the counter array to determine if any of them have been decremented to zero. If not, the data processor exits the interrupt portion 181–189 of the program and returns to the step 172 of awaiting receipt of a datum signal. If one or more counters have been decremented to zero, the next step 183 is to evaluate the destination information to determine if the primary destination bin 44 is available. Since such bin 44 may be unavailable, for example because it has been removed from the drop chute assembly 13 or is full, the data processor 14 checks the destination bin and any programmed alternate bins to determine if one of them is available for receipt of an envelope. If not, the envelope cannot be delivered and the data processor 14 exits the interrupt portion 181–189 of the program and returns to the step 172 of awaiting receipt of the datum signal. If the destination bin 44 or some alternate bin 44 is available to receive an envelope, the data processor 14 executes the next step 184 of configuring the drop chute assemblies 13 and the release assembly 79 as necessary to release the envelope from the carrier 27 at the proper moment and route it to the desired destination or alternate bin 44. A counter is also loaded with a short distance value which is also decremented in the step 182. When this counter reaches zero, the release assembly associated therewith is deenergized so that subsequent carriers 27 are not caused to release their envelopes improperly.

In the next step 186, the data processor 14 monitors the microswitches which detect the position of the diverter gates 88, 91 to determine if they are configured to route the envelope to the desired bin 44. The data processor reviews this configuration check in the next step 187 and, if the drop chute assembly is not properly configured, it proceeds to the next step 188 of deactivating the release assembly 79 associated with the improperly configured drop chute assembly 13 and returns to the step 172 of waiting for receipt of a datum signal. If the drop chute assembly 13 was found to be properly configured in the step 187, the interrupt program 18–189 continues to the step 189 of saving such routing information of envelopes as may be desired for management reports or the like. The data processor then exits the interrupt portion of the program and returns to the step 172 of awaiting receipt of a datum signal. Of course, if more than one counter was decremented to zero in the step 181, the above steps 181–189 are repeated with respect to each carrier 27 release assembly 79 and drop chute assembly 13 as necessary to route the envelopes to the desired bins 44.

As shown by FIG. 11, the doors 56 of the carriers 27 are held in partially-open position, as those carriers move upwardly toward the guide 192. Those doors are held in that position by the confining action which the groove-type cam 74 applies to the trip levers of those doors. Although those doors are partially-open, they will keep envelopes from sliding down past them, even when those envelopes are engaged by the ridges 193 on the guide 192.

The door 56 of the carrier 27 in the upper left-hand portion of FIG. 11 is shown in a partially-open position, thereby indicating that an envelope is to be delivered to the forward-most drop chute assembly 13 of the drop chute assemblies of the right section 36. That door was permitted to close, as the trip lever 58 thereof moved beyond the exit end of the groove-type cam 74; but it was caused to start moving to the position of FIG. 11 by the ramped face 84 of the release assembly 79 for that forward-most drop chute assembly. The door 56 will thereafter remain in open position until it engages the entry end of the groove-type cam 74 in the lower level 29.

We claim:

1. A sorting apparatus for sorting articles comprising a motion-imparting conveyor which follows a predetermined path during the sorting of said articles, a plurality of pocket-type carrying means for selectively carrying articles from a loading location to a plurality of unloading locations that are arranged along portions of the length of said predetermined path, each of a plurality of said unloading locations having a plurality of article-receiving receptacles, said pocket-type carrying means being secured to, and being movable with, said conveyor throughout the loading and sorting of articles, each of said pocket-type carrying means being larger than each article which is to be sorted by said sorting apparatus so each of said pocket-type carrying means freely receives and loosely holds, but substantially encloses, each article supplied to it and also freely releases said article for gravity-induced fall away from said pocket-type carrying means, means adjacent each of said unloading locations which is selectively associated with said pocket-type carrying means for effecting the release of selected articles from said pocket-type carrying means such that said selected articles respond to gravity to fall away from said pocket-type carrying means at said unloading locations after said releasing means effect the release of said selected articles from said pocket-type carrying means, receiving and guiding means at said unloading locations that are positioned below the level of said pocket-type carrying means, as said releasing means effect the release of said articles from said pocket-type carrying means, to receive said selected articles after said selected articles have started to fall away from said pocket-type carrying means and to selectively apply laterally-directed, receptacle-selecting, guiding forces to selected ones of said articles while permitting said selected ones of said articles to continue their fall away from said pocket-type carrying means, said laterally-directed, receptacle-selecting, guiding forces deflecting said ones of said selected articles to selected ones of said plurality of receptacles at said unloading locations as said selected ones of said articles continue to fall away from said pocket-type carrying means at said unloading locations, said plurality of receptacles at said plurality of unloading locations being grouped transversely of said predetermined path to limit the length of each of said plurality of unloading locations in the direction of said predetermined path, one of said pocket-type carrying means transporting an article to a selected one of said unloading locations to provide a sorting for said article along said predetermined path, one of said releasing means and said one pocket-type carrying means freeing said article for a fall and one of said receiving and guiding means receiving said article and guiding it toward a selected one of said transversely-grouped receptacles at said one unloading location to provide a further sorting for said article along a path which is transverse of said predetermined path, said one pocket-type carrying means releasing said one article while said conveyor is moving said one pocket-type carrying means in a predetermined direction along said predetermined path, and the receiving and guiding means at said one unloading location limiting movement of said released article in said predetermined direction and selectively helping to guide said released article transversely relative to said predetermined path to one of said transversely-grouped receptacles at said one unloading location.

2. The apparatus of claim 1 wherein said receiving and guiding means include diverting means for selectively diverting articles to selected ones of said plurality of transversely-grouped receptacles, whereby each of said articles may be selectively guided or diverted to a predetermined receptacle.

3. The apparatus of claim 1 wherein said receiving and guiding means include diverting means that are tiltable to apply said laterally-directed, receptacle-selecting, guiding forces to said selected ones of said articles, whereby each of said articles is selectively guided to a predetermined receptacle, wherein said plurality of pocket-type carrying means are arranged along the length of said conveyor with substantially-equal center-to-center spacings, wherein said conveyor repeatedly circulated each of said pocket-type carrying means from a loading station to, and past, each of said unloading locations, and wherein said unloading locations of said plurality of unloading locations are arranged along said portion of said length of said conveyor with substantially-equal center-to-center spacings.

4. The apparatus of claim 1 wherein each of said pocket-type carrying means has a closure for the bottom thereof which is disposable in a closed position to enable said pocket-type carrying means to hold an article therein, wherein said closure is adapted to move away from said bottom of said pocket-type carrying means to an open position to free said article as said pocket-type carrying means becomes associated with one of said releasing means, wherein a hinge secures said closure to said pocket-type carrying means while permitting said closure to be disposed in said closed position or in said open position, and wherein said hinge has an axis that is parallel to said predetermined path, whereby said closure rotates between said closed position and said open position about an axis that is parallel to said predetermined path.

5. The apparatus of claim 1 wherein each of said pocket-type carrying means has a vertical axis and a horizontal axis as it is being moved by said conveyor past said plurality of unloading locations, wherein each of said pocket-type carrying means has an article-holding portion and also has a projection, at one end of said vertical axis, which extends outwardly beyond said article-holding portion, and wherein said projection is secured to said conveyor to hold said horizontal axis of said pocket-type carrying means parallel to said predetermined path.

6. The apparatus of claim 1 wherein each of said pocket-type carrying means has a vertical axis and a horizontal axis as it is being moved by said conveyor past said plurality of unloading locations, wherein each of said pocket-type carrying means has an article-holding portion and also has a projection, at one end of said vertical axis, which extends outwardly beyond said article-holding portion into proximity to said conveyor, and wherein said projection is secured to said conveyor to constitute the sole securement of said pocket-type carrying means to said conveyor.

7. The apparatus of claim 1 wherein said conveyor is an endless chain, wherein a track guides the movement of said endless chain, wherein said track constitutes an elongated enclosure that confines and substantially encloses said endless chain, and wherein said endless chain has a plurality of turns intermediate the length of said predetermined path.

8. A sorting apparatus as claimed in claim 1 wherein each of said pocket-type carrying means is moved away from said loading station, past said unloading locations, and then to said loading station as said motion-imparting conveyor follows said predetermined path, wherein an opening means is located adjacent said predetermined path intermediate said portions of said predetermined path and said loading station so each pocket-type carrying means is moved past said opening means as said pocket-type carrying means is moved beyond said portions of said predetermined path and toward said loading station, and wherein said opening means automatically and positively causes the closure of every pocket-type carrying means, which is in closed position as said pocket-type carrying means approaches said opening means, to be released for movement to open position, to permit any article within said pocket-type carrying means to fall away from said pocket-type carrying means, whereby each and every pocket-type carrying means will be empty as it is subsequently moved into said loading station.

9. A sorting apparatus as claimed in claim 1 wherein each of said pocket-type carrying means has a door that is disposable in an open position or in a closed position, and wherein each of said pocket-type carrying means has spring means that resists movement of said door out of said open position and that also resists movement of said door out of said closed position.

10. A sorting apparatus for sorting articles comprising a motion-imparting conveyor which follows a predetermined path during the sorting of said articles, a plurality of pocket-type carrying means for selectively carrying articles from a loading location to a plurality of unloading locations that are arranged along portions of the length of said predetermined path, each of a plurality of said unloading locations having a plurality of article-receiving receptacles, said pocket-type carrying means being secured to, and being movable with, said conveyor throughout the loading and sorting of articles, each of said pocket-type carrying means being larger than each article which is to be sorted by said sorting apparatus so each of said pocket-type carrying means freely receives and loosely holds, but substantially encloses, each article supplied to it and also freely releases said article for gravity-induced fall away from said pocket-type carrying means, means adjacent each of said unloading locations which is selectively associated with said pocket-type carrying means for effecting the release of selected articles from said pocket-type carrying means such that said selected articles fall away from said unloading locations after said releasing means effect the release of said selected articles from said pocket-type carrying means, receiving and guiding means at said unloading locations that are positioned below said pocket-type carrying means, as said releasing means effect the release of said selected articles from said pocket-type carrying means, to receive and to selectively apply laterally-directed, receptacle-selecting, guiding forces to selected ones of said articles, said laterally-directed, receptacle-selecting, guiding forces deflecting said selected ones of said articles to selected ones of said plurality of receptacles at said unloading locations as said selected ones of said articles fall away from said pocket-type carrying means at said unloading locations, said plurality of receptacles at said plurality of unloading stations being grouped transversely of said predetermined path to limit the length of each of said plurality of unloading locations in the direction of said predetermined path, one of said pocket-type carrying means transporting an article to a selected one of said unloading locations to provide a first sorting for said article along said predetermined path, one of said releasing means and said one pocket-type carrying means freeing said article for a fall and one of said receiving and guiding means receiving said article and selectively guiding it toward a selected one of said transversely-grouped receptacles at said one unloading location to provide a second sorting for said article along a path which is transverse of said predetermined path, said one pocket-type carrying means releasing said one article while said conveyor is moving said one pocket-type carrying means in a predetermined direction along said predetermined path, the receiving and guiding means at said one unloading location limiting movement of said released article in said predetermined direction and selectively helping to guide said released article transversely relative to said predetermined path to one of said transversely-grouped receptacles at said one unloading location, at least one of said receptacles normally being adapted to receive articles which are intended to be directed to said one receptacle, at least one back-up receptacle that is adapted to receive articles which are intended to, but which are not, directed to said one receptacle, said apparatus having a sensing means adjacent said one receptacle for detecting the ability of said one receptacle to receive articles which are intended to be directed to said one receptacle, and means which responds to a signal from said sensing means, whenever said one receptacle is unable to receive articles, to route all further such articles to said back-up receptacles as long as said sensing means supplies said signal indicating that said one receptacle is unable to receive articles.

11. A sorting apparatus for sorting articles comprising means for carrying an article to one unloading location of a number of spaced unloading locations, means operatively associated with said carrying means for releasing said article from said carrying means at said one unloading location such that said article moves away from said one unloading location after said releasing means releases it from said carrying means, means for selectively diverting said article to one of a plurality of receiving locations as it moves away from said one unloading location, data processing means for selectively controlling said diverting means and said releasing means, whereby said article may be diverted to a predetermined receiving location adjacent an unloading location, said carrying means being one of a plurality of pocket-type carriers, means for circulating said pocket-type carriers from a loading station to said spaced unloading locations and to rotate said pocket-type carriers during a part of said circulating of said pocket-type carriers from said loading station to said spaced unloading locations, each of said carriers including a plurality open front portion, each of said pocket-type carriers having a long axis and a short axis in elevation and having said long axis generally vertical as said pocket-type carrier is moved past said spaced unloading locations, each of said pocket-type carriers having a projection, adjacent one end of said long axis, which extends beyond the article-carrying portion of said pocket-type carrier, to be secured to said circulating means, and the securement of said projection to said circulating means enabling said projection to remain virtually stationary during a portion of said rotation of said pocket-type carriers.

12. The apparatus of claim 11 further comprising pallet means for receiving an article, and means mounting said pallet means such that said pallet means tips from a horizontal position to an inclined position to slide said article into one of said pocket-type carriers.

13. The apparatus of claim 11 wherein said pocket-type carriers are spaced apart along the length of said conveyor, wherein said unloading locations also are spaced apart along the length of said conveyor, and wherein the spacing of said pocket-type carriers differs from that of said unloading locations.

14. The apparatus of claim 11 wherein said circulating means circulates said pocket-type carriers past a fixed location in advance of said loading station, and further comprising means operationally associated with said circulating means for releasing every article from every pocket-type carrier before said pocket-type carrier is recirculated to said loading station.

15. The apparatus of claim 11 wherein said pocket-type carriers are recirculated past said loading station and are carried from a lower level to an upper level during the course of being circulated from said loading station to said spaced unloading locations.

16. The apparatus of claim 11 wherein said pocket-type carriers are circulated through an arcuate section, and further comprising an arcuate member having an irregular surface positioned adjacent said arcuate section for engaging articles protruding past the adjacent ends of pocket-type carriers conveyed therepast.

17. The apparatus of claim 11 wherein said diverting means is pivotably mounted to a chute, and wherein said diverting means is actuated by a rotary actuator connected thereto by means of a segmented arm, said arm being deflected past its straight configuration when said diverting means is in position to allow an article to pass thereby.

18. The sorting apparatus of claim 11 wherein said pocket-type carriers are rotated from a horizontal orientation to a vertical orientation as they are circulated.

19. A method of sorting articles comprising the steps of releasably loading a pocket-type carrying means of a conveyor, which follows a predetermined path of movement, with an article so said article is loosely held but is confined so it is substantially parallel to said path of movement of said conveyor, loading said pocket-type carrying means with said article while said conveyor is moving said pocket-type carrying means along said path of movement of said conveyor, circulating said conveyor past a plurality of release locations while permitting said pocket-type carrying means to loosely hold and confine said article but to hold said article so it is substantially parallel to said path of movement of said conveyor, releasing said article from said pocket-type carrying means of said conveyor at one of said release locations such that it falls away from said pocket-type carrying means, receiving and selectively applying laterally-directed, receptacle-selecting, guiding forces to said article to guide said article along a different path of movement after said article has been released from said pocket-type carrying means at said one release location, said article moving toward a selected one of a plurality of receptacles, which are grouped transversely of said predetermined path of movement of said conveyor at said one release location, as said article moves along said different path of movement, whereby each article is held substantially parallel to said path of movement of said conveyor as it is moved along said predetermined path of movement and then is received after it is released from said pocket-type carrying means and is guided along said different path of movement to said selected receptacle at said one release location.

20. The method of claim 19 wherein at least three articles are scheduled for release from different pocket-type carrying means at said one release location, wherein one of said articles is permitted to fall essentially straight downwardly into a first receptacle, wherein a second of said articles is guided transversely of said predetermined path of movement of said conveyor in one direction to a second receptacle, and wherein a third of said articles is guided transversely of said predetermined path of movement of said conveyor in the opposite direction to a third receptacle.

21. A sorting apparatus for sorting articles comprising a motion-imparting conveyor which follows a predetermined path during the sorting of said articles, pocket-type means for carrying an article from a loading location to an unloading location;

said pocket-type carrying means being secured to, and being movable with, said conveyor throughout the loading and sorting of articles;

said pocket-type carrying means being larger than each article which is to be sorted by said sorting apparatus so it freely receives and encloses and confines each article supplied to it;

said pocket-type carrying means having a long axis and a short axis in plan view and said pocket-type carrying means being secured to said conveyor so said long axis of said pocket-type carrying means is parallel to said predetermined path, thereby enabling each article which has a long axis and a short axis in plan view and which is carried by said pocket-type carrying means to have its long axis parallel to said predetermined path;

means adjacent said unloading location which is selectively operatively associated with said pocket-type carrying means for releasing an article from said pocket-type carrying means at said unloading location such that said released article falls away from said unloading location after said releasing means effects the release of said article from said pocket-type carrying means; and receiving and guiding means positioned below said pocket-type carrying means, as said releasing means effect the release of articles from said pocket-type carrying means, to receive said selected articles after said selected articles have started to fall away from said pocket-type carrying means and to selectively apply laterally-directed, receptacle-selecting, guiding forces to selected ones of said articles while permitting said selected ones of said articles to continue their fall away from said pocket-type carrying means, said laterally-directed, receptacle-selecting, guiding forces deflecting said selected ones of said articles to selected ones of a plurality of receptacles as said selected ones of said articles fall away from said unloading locations;

said plurality of receptacles being grouped transversely of said predetermined path to limit the length of said unloading location in the direction of said predetermined path.

22. A sorting apparatus for sorting articles comprising a motion-imparting conveyor which follows a predetermined path during the sorting of said articles, pocket-type means for carrying an article from a loading location to a selected one of a plurality of unloading locations, along said predetermined path;

said pocket-type carrying means being secured to, and being movable with, said conveyor throughout the loading and sorting of articles;

said pocket-type carrying means being larger than each article which is to be sorted by said sorting apparatus so it freely receives and encloses and confines each article supplied to it;

said pocket-type carrying means having a long axis and a short axis in plan view and said pocket-type carrying means being secured to said conveyor so said long axis of said pocket-type carrying means is parallel to said predetermined path, thereby enabling each article which has a long axis and a short axis in plan view and which is carried by said pocket-type carrying means to have its long axis parallel to said predetermined path;

releasing means adjacent said plurality of unloading locations which selectively coacts with said pocket-type carrying means to release a selected article held thereby as said pocket-type carrying means moves into position above said selected one of said unloading locations, each of said unloading locations having a plurality of receptacles that are grouped transversely of said predetermined path and that are dimensioned to accomodate said selected article released by said pocket-type carrying means, receiving and guiding means at said unloading locations that are positioned below the level of said pocket-type carrying means, as said releasing means effect the release of said articles from said pocket-type carrying means, to receive said selected articles after said selected articles have started to fall away from said pocket-type carrying means and to selectively apply laterally-directed, receptacle-selecting, guiding forces to selected ones of said articles while permitting said selected ones of said articles to continue their fall away from said pocket-type carrying means, and said pocket-type carrying means facilitating the selective directing, of an article which is to be released from said pocket-type carrying means, transversely of said predetermined path and toward a selected one of said transversely-grouped receptacles, of said selected one of said unloading locations, by holding said article with the long axis of said article parallel to said predetermined path, said sorting apparatus performing a first sorting operation on an article by moving said article in a generally-horizontal direction into position over said selected one of said unloading locations;

said sorting apparatus performing a second sorting operation on said article by receiving said article as it falls from said pocket-type carrying means and causing said article to fall toward and into said selected one of said transversely-grouped receptacles at said selected one of said unloading locations.

23. A sorting apparatus as claimed in claim 22 wherein said transverse grouping of said plurality of receptacles at said unloading locations provides that the length of each of said unloading locations is substantially equal in the direction of said predetermined path to the length of any one of said receptacles, of said unloading location, in said direction of said predetermined path.

* * * * *